US008879955B2

(12) United States Patent
Wakayama

(10) Patent No.: US 8,879,955 B2
(45) Date of Patent: Nov. 4, 2014

(54) DRUM UNIT AND IMAGE FORMING APPARATUS HAVING DRUM UNIT

(71) Applicant: Kyocera Document Solutions Inc., Osaka (JP)

(72) Inventor: Kei Wakayama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 45 days.

(21) Appl. No.: 13/749,367

(22) Filed: Jan. 24, 2013

(65) Prior Publication Data

US 2013/0188989 A1 Jul. 25, 2013

(30) Foreign Application Priority Data

Jan. 25, 2012 (JP) ..... 2012-012645

(51) Int. Cl.
*G03G 15/00* (2006.01)

(52) U.S. Cl.
CPC ..... *G03G 15/751* (2013.01)
USPC ..... 399/117

(58) Field of Classification Search
USPC ..... 399/117
See application file for complete search history.

(56) References Cited

U.S. PATENT DOCUMENTS

| | | | | |
|---|---|---|---|---|
| 5,444,516 | A * | 8/1995 | Michlin et al. | 399/117 X |
| 5,815,773 | A * | 9/1998 | Zaman | 399/117 |
| 7,630,667 | B2 * | 12/2009 | Huang et al. | 399/117 |
| 7,680,435 | B2 * | 3/2010 | Kusano | 399/117 |
| 2010/0135697 | A1 * | 6/2010 | Hashimoto | 399/117 |

FOREIGN PATENT DOCUMENTS

| | | |
|---|---|---|
| JP | 62-065049 | 3/1987 |
| JP | 07-261498 | 10/1995 |
| JP | 2001-166667 | 6/2001 |
| JP | 2001-331061 | 11/2001 |
| JP | 2002-060044 | 2/2002 |

* cited by examiner

*Primary Examiner* — Sandra Brase
(74) *Attorney, Agent, or Firm* — K&L Gates LLP

(57) ABSTRACT

A drum unit has a photosensitive drum, a circular tube member, a housing, and a bearing portion. The photosensitive drum includes a drum sleeve, a flange portion, and a supporting portion. The supporting portion is press-fitted into the inner peripheral surface of the circular tube member made of metal. The sliding surface of the circular tube member is rotatably inserted into the bearing portion attached to the housing of the drum unit.

13 Claims, 9 Drawing Sheets

DRUM UNIT AND IMAGE FORMING APPARATUS HAVING DRUM UNIT

INCORPORATION BY REFERENCE

This application is based upon, and claims the benefit of priority from, corresponding Japanese Patent Application No. 2012-012645 filed in the Japan Patent Office on Jan. 25, 2012, the entire contents of which are incorporated herein by reference.

BACKGROUND

The present disclosure relates to a drum unit having a photosensitive drum, and an image forming apparatus having same.

The drum unit including the photosensitive drum and a main body supporting the photosensitive drum is known. The photosensitive drum has a hollow cylindrical drum sleeve, and resin flanges press-fitted into both ends of the drum sleeve. The flanges each have a supporting portion protruding from a lateral face thereof in an axial direction. The drum unit main body has sliding bearing portions at locations corresponding to both axial ends of the photosensitive drum. The supporting portions are inserted into the sliding bearing portions, and the photosensitive drum is thereby attached to the drum unit main body. The photosensitive drum is rotationally driven with the supporting portions and the sliding bearing portions sliding on each other.

In the case of a supporting structure for the photosensitive drum in which, as described above, supporting portions protruding from flanges are directly supported by bearing portions, the resin flanges expand due to the heat generated by friction during the rotational driving. As a result, the supporting portions of the flanges and the bearing portions of the drum unit main body interfere with each other, sometimes causing rotation failure. For this reason, a clearance that takes into account thermal expansion is provided between the supporting portions of the flanges and the bearing portions of the drum unit main body. There has been proposed in the art the use of a resin material having a low linear expansion coefficient for the flanges, and the resin material is selected so that the rotational driving of the photosensitive drum is not affected by thermal expansion of the flanges.

However, in the above art, thermal expansion of the flanges is allowed within a predetermined range, and therefore when the environmental temperature changes, the clearance between the flanges and the bearing portions changes. This change in clearance is likely to affect the rotation accuracy of the photosensitive drum. In particular, in the case where the photosensitive drum rotates at a high speed, the expansion of the flanges due to friction is significant, and therefore a large clearance is provided.

When a large clearance is provided, the rotational driving force when the flanges are not thermally expanded is less likely to be transmitted accurately, the rotation accuracy of the photosensitive drum decreases, and the image quality of the image forming apparatus decreases. In addition, it is difficult to suppress the abrasion of the supporting portions caused by repeated rotation of the photosensitive drum only by selection of resin material. Therefore, the abrasion of the supporting portions may destabilize the drive transmission, and may cause further rotation failure.

SUMMARY

A drum unit according to an embodiment of the present disclosure includes a photosensitive drum, a circular tube member, a housing, and a bearing portion. The photosensitive drum includes a drum sleeve, a flange, and a supporting portion made of resin. The drum sleeve is a hollow cylindrical body having a surface on which a latent image is formed and bearing a toner image corresponding to the latent image. The flange is press-fitted into an end of the drum sleeve and rotatably supports the drum sleeve. The supporting portion protrudes from a lateral face of the flange in an axial direction of the drum sleeve, and serves as a rotating shaft for rotation of the drum sleeve. The circular tube member is made of metal, extends in the axial direction, and has a first inner peripheral surface forming a space, and a first outer peripheral surface that is opposite from the first inner peripheral surface. The housing rotatably supports the photosensitive drum. The bearing portion is fixed to the housing, and has a second inner peripheral surface facing the first outer peripheral surface and forming a space. The supporting portion is press-fitted into the first inner peripheral surface of the circular tube member, and the circular tube member is inserted into the second inner peripheral surface of the bearing portion.

An image forming apparatus according to another embodiment of the present disclosure includes a drum unit, an exposure device, a developing device, a transfer device, and a cleaning device. The drum unit includes a photosensitive drum, a circular tube member, a housing, and a bearing portion. The photosensitive drum includes a drum sleeve, a flange, and a supporting portion made of resin. The drum sleeve is a hollow cylindrical body having a surface on which a latent image is formed and bearing a toner image corresponding to the latent image. The flange is press-fitted into an end of the drum sleeve and rotatably supports the drum sleeve. The supporting portion protrudes from a lateral face of the flange in an axial direction of the drum sleeve, and serves as a rotating shaft for rotation of the drum sleeve. The circular tube member is made of metal, extends in the axial direction, and has a first inner peripheral surface forming a space, and a first outer peripheral surface that is opposite from the first inner peripheral surface. The housing rotatably supports the photosensitive drum. The bearing portion is fixed to the housing, and has a second inner peripheral surface facing the first outer peripheral surface and forming a space. The supporting portion is press-fitted into the first inner peripheral surface of the circular tube member, and the circular tube member is inserted into the second inner peripheral surface of the bearing portion.

Additional features and advantages are described herein, and will be apparent from the following Detailed Description and the figures.

DETAILED DESCRIPTION

An embodiment of the present disclosure will be described below with reference to the drawings. However, elements such as configuration and arrangement described in the embodiment are illustrative only and are not intended to limit the scope of the disclosure.

Figure 1:
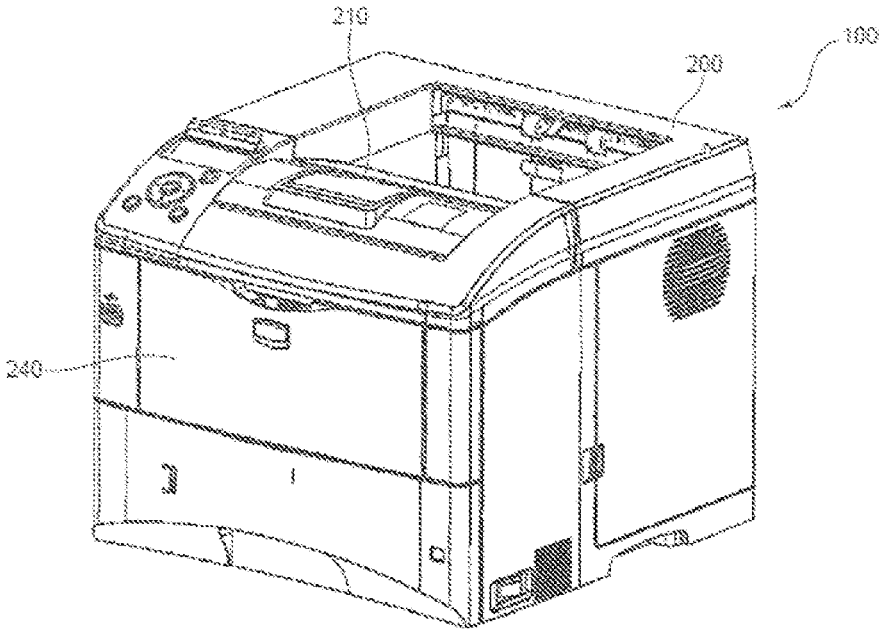
FIG. 1 is a diagrammatic perspective view illustrating an image forming apparatus of an embodiment of the present disclosure.
Figure 2:
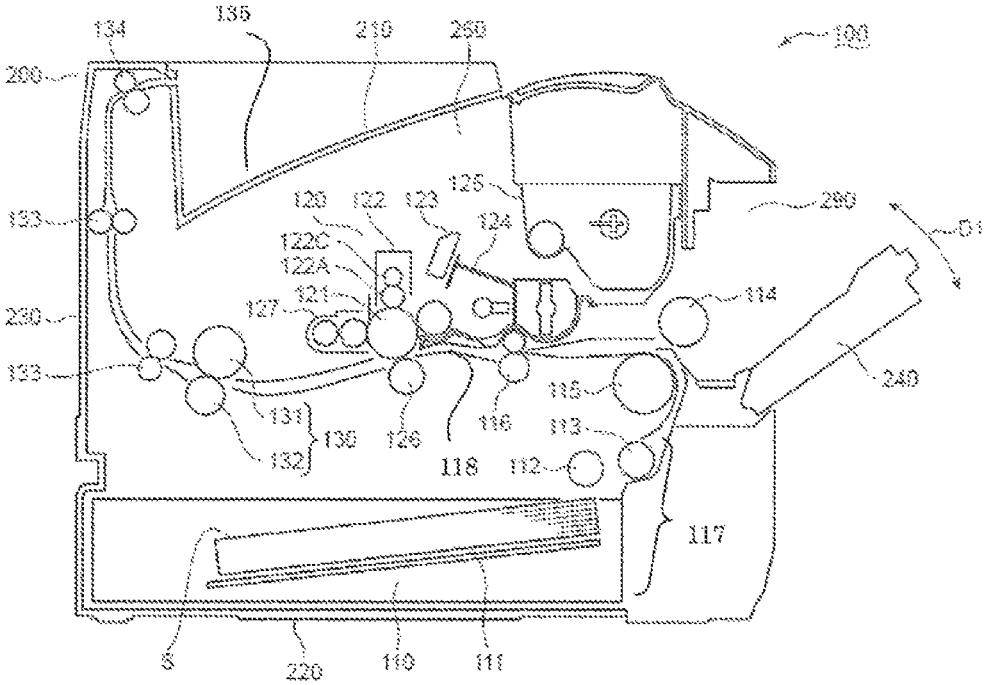
FIG. 2 is an internal sectional view illustrating the image forming apparatus of the embodiment.

FIG. 1 is a diagrammatic perspective view of an image forming apparatus 100 according to an embodiment of the present disclosure. FIG. 2 schematically shows the internal structure of the image forming apparatus 100 shown in FIG. 1. The image forming apparatus 100 shown in FIG. 1 and FIG. 2 is a so-called monochrome printer. However, it may be a color printer, a fax machine, a multifunction device having the functions of these, or another apparatus for forming a toner image on a sheet.

The image forming apparatus 100 has a case 200 that houses various devices for forming an image on a sheet S. The case 200 includes an upper wall 210, a bottom wall 220, a back wall 230 erected between the upper wall 210 and the bottom wall 220, and a manual feed tray 240 attached on the opposite side from the back wall 230.

The manual feed tray 240 is rotatable upward and downward about its lower end (arrow D1 in FIG. 2). As shown in FIG. 2, when the manual feed tray 240 is rotated downward, an opening 290 formed in the case 200 is opened. The opening 290 communicates with the internal space of the case 200. Therefore, the user can access the various devices housed in the internal space 260 of the case 200 through the opening 290. When the manual feed tray 240 is rotated upward, the opening 290 is closed. As a result, unnecessary access by the user to the internal space 260 is prevented.

The image forming apparatus 100 has a feeding portion 117, a conveying portion 118, and an image forming portion 120. The feeding portion 117 has a cassette 110, a pickup roller 112, and a first feeding roller 113. The conveying portion 118 has a second feeding roller 114, a conveying roller 115, and a registration roller pair 116. The cassette 110 stores sheets S therein. The cassette 110 has a lifting plate 111 that supports the sheets S. The lifting plate 111 is inclined so as to push up the leading edges of the sheets S. The pickup roller 112 is positioned over the leading edges of the sheets S pushed up by the lifting plate 111. When the pickup roller 112 rotates, the uppermost sheet S is pulled out from the cassette 110.

The first feeding roller 113 is located downstream of the pickup roller 112. The first feeding roller 113 feeds the sheet S further downstream. The second feeding roller 114 is located near the pivot point of the manual feed tray 240. The second feeding roller 114 pulls the uppermost sheet S on the manual feed tray 240 into the inside of the case 200. The user can selectively use the sheets S stored in the cassette 110 or the sheets S placed on the manual feed tray 240. The conveying roller 115 is located downstream of the first feeding roller 113 and the second feeding roller 114. The conveying roller 115 feeds the sheet S sent out by the first feeding roller 113 and the second feeding roller 114 further downstream.

The registration roller pair 116 corrects the position of the sheet in a direction perpendicular to the conveying direction. The position of the image formed on the sheet S is thereby adjusted. The registration roller pair 116 feeds the sheet S to the image forming portion 120 in time relationship with the image formation by the image forming portion 120.

The image forming portion 120 has a photosensitive drum 121, a charging device 122, an exposure device 123, a developing device 124, a toner container 125, a transfer device 126, and a cleaning device 127.

The photosensitive drum 121 has a substantially hollow cylindrical shape. An electrostatic latent image is formed on the peripheral surface of the photosensitive drum 121, and the photosensitive drum 121 bears a toner image corresponding to the electrostatic latent image. The supporting structure for the photosensitive drum 121 will be described later.

A predetermined voltage is applied to the charging device 122, and the charging device 122 charges the peripheral surface of the photosensitive drum 121 substantially uniformly. The peripheral surface of the photosensitive drum 121 charged by the charging device 122 is irradiated with light, such as laser light, by the exposure device 123. The peripheral surface of the photosensitive drum 121 is irradiated with laser light according to image data outputted from an external device (not shown) such as a personal computer communicatably connected to the image forming apparatus 100. As a result, an electrostatic latent image corresponding to the image data is formed on the peripheral surface of the photosensitive drum 121.

The developing device 124 supplies toner to the peripheral surface of the photosensitive drum 121 on which the electrostatic latent image is formed. The toner container 125 supplies toner to the developing device 124. The toner container 125 supplies toner to the developing device 124 gradually or as needed. When the developing device 124 supplies toner to the peripheral surface of the photosensitive drum 121, the electrostatic latent image is developed.

The transfer device 126 is rotatably positioned so as to be in contact with the peripheral surface of the photosensitive drum 121. When the sheet S fed from the registration roller pair 116 passes between the photosensitive drum 121 and the transfer device 126, the toner image formed on the peripheral surface of the photosensitive drum 121 is transferred to the sheet S.

After the toner image is transferred to the sheet S, the cleaning device 127 removes toner remaining on the peripheral surface of the photosensitive drum 121. The peripheral surface of the photosensitive drum 121 cleaned by the cleaning device 127 passes under the charging device 122 and is again uniformly charged. After that, the above-described toner image formation is newly performed.

In addition, the image forming apparatus 100 has a fixing portion 130 on the downstream side in the conveying direction of the image forming portion 120. The fixing portion 130 fixes the toner image on the sheet S. The fixing portion 130 has a heating roller 131 that melts the toner on the sheet S, and a pressure roller 132 that presses the sheet S against the heating roller 131. When the sheet S passes between the heating roller 131 and the pressure roller 132, the toner image is fixed to the sheet S.

The image forming apparatus 100 also has a plurality of conveying roller pairs 133 located downstream of the fixing portion 130, and a discharge roller pair 134 located downstream of the conveying roller pairs 133. The sheet S is fed upward by the conveying roller pairs 133, and is finally discharged from the case 200 by the discharge roller pair 134. Sheets S discharged from the case 200 are stacked in a discharge portion 135 on the upper wall 210.

Figure 3:
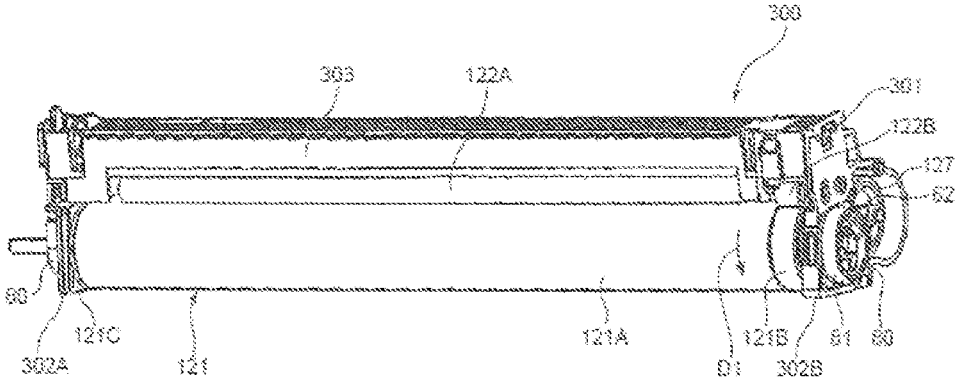
FIG. 3 is a diagrammatic perspective view illustrating a drum unit of the embodiment.
Figure 4:
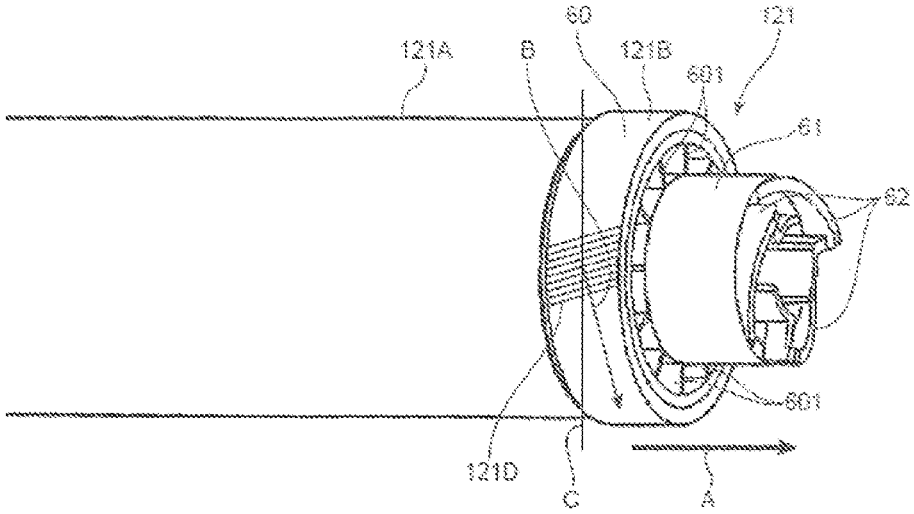
FIG. 4 is a diagrammatic perspective view illustrating a flange attached to an end of the drum unit of the embodiment.
Figure 5:
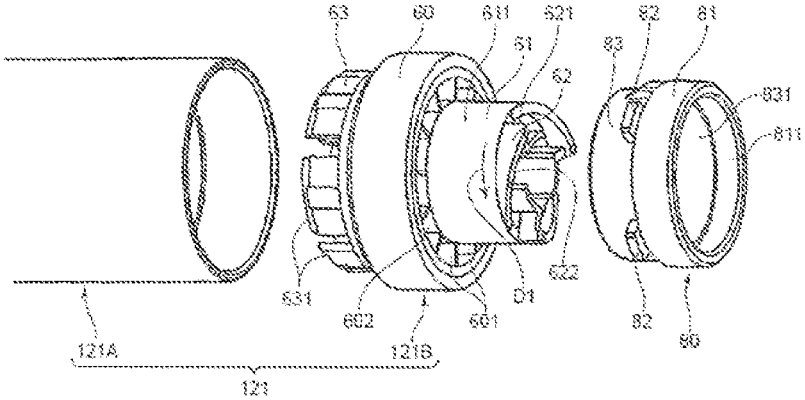
FIG. 5 is an exploded perspective view illustrating a supporting structure for a drum unit without a circular tube member for comparison with the embodiment.
Figure 6:
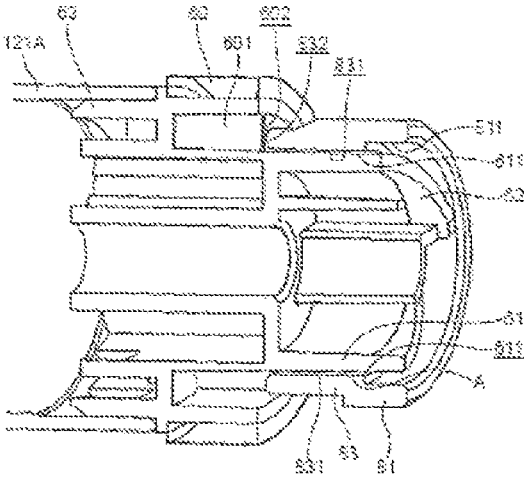
FIG. 6 is an enlarged sectional view illustrating the supporting structure for a drum unit without a circular tube member for comparison with the embodiment.
Figure 7:
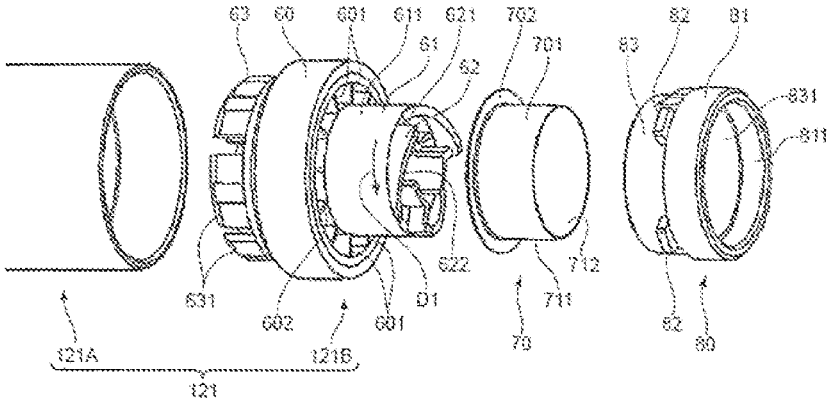
FIG. 7 is an exploded perspective view illustrating a supporting structure for a drum unit of the embodiment.
Figure 8:
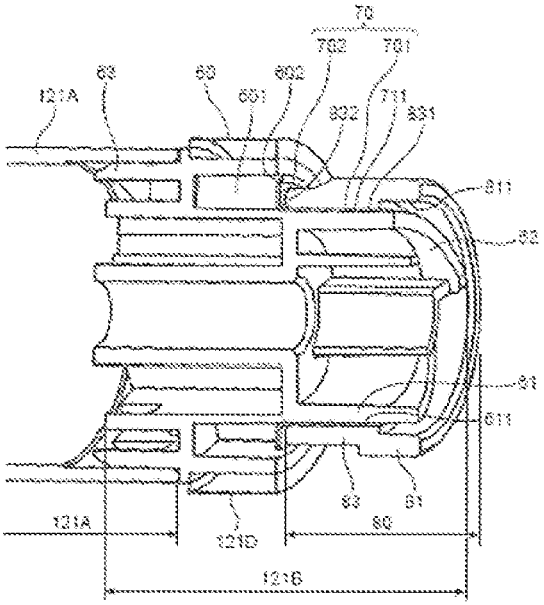
FIG. 8 is an enlarged sectional view illustrating the supporting structure for a drum unit of the embodiment.
Figure 9:
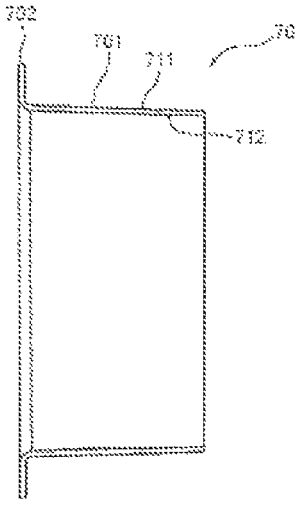
FIG. 9 is a sectional view of a circular tube member of the embodiment.

Next, the supporting structure for the photosensitive drum 121 according to this embodiment will be described in detail with reference to FIG. 3 to FIG. 9. In this embodiment, the photosensitive drum 121 is rotatably supported by a drum unit 300. FIG. 3 is a diagrammatic perspective view of the drum unit 300 according to this embodiment. FIG. 4 is an enlarged diagrammatic perspective view of one end of the photosensitive drum 121 according to this embodiment. FIG. 5 and FIG. 7 are exploded perspective views illustrating the supporting structure for the photosensitive drum 121. FIG. 6 and FIG. 8 are enlarged sectional views for illustrating the supporting structure for the photosensitive drum 121. FIG. 9 is an enlarged sectional view of a circular tube member 70 according to this embodiment. FIG. 5 and FIG. 6 show a state where a circular tube member 70 is not provided, and FIG. 7 and FIG. 8 shows this embodiment.

Referring to FIGS. 2 and 3, the drum unit 300 has a housing 301, a photosensitive drum 121, a charging device 122 having a charging roller 122A and a charging cleaner 122C, and a cleaning device 127. The housing 301 has a front wall 302A, a back wall 302B, and a charge housing 303. The housing 301 has an inverted substantially U-shape elongated in the axial direction of the photosensitive drum 121 in front view. At both axial ends of the housing 301, the front wall 302A and the back wall 302B, which are plate-like, are perpendicularly positioned to the axial direction, and parallel to each other. The photosensitive drum 121 is rotatably supported between the front wall 302A and the back wall 302B. The front wall 302A and the back wall 302B are positioned so as to face the lateral faces of the photosensitive drum 121 in the axial direction.

The charge housing 303 has a box-like shape and connects the front wall 302A and the back wall 302B in the axial direction. The charge housing 303 rotatably supports therein the charging roller 122A and the charging cleaner 122C. The charging roller 122A supported by the charge housing 303 is in contact with the photosensitive drum 121 below it, and charges the photosensitive drum 121 to a predetermined potential. The charging roller 122A has a charging roller gear 122B at its right end in the axial direction. The charging roller gear 122B is disposed coaxially with the charging roller 122A. Rotational driving force is transmitted from a helical gear formed in a flange 121B (described later) of the photosensitive drum 121 to the charging roller gear 122B, and the charging roller 122A is rotationally driven. The charging cleaner 122C is in contact with the charging roller 122A under its own weight and cleans the surface of the charging roller 122A. The housing 301 supports the cleaning device 127 in contact with the photosensitive drum 121 along the axial direction, behind the photosensitive drum 121.

As shown in FIG. 3 to FIG. 5, the photosensitive drum 121 includes a drum sleeve 121A and a pair of flanges 121B and 121C located at both ends of the drum sleeve 121A. A latent image is formed on the surface of the drum sleeve 121A, and the drum sleeve 121A bears a toner image corresponding to the latent image. The drum sleeve 121A is a hollow cylindrical body made of an aluminum or stainless material. A photosensitive layer on which a predetermined latent image is formed, is formed on the peripheral surface of the hollow cylindrical body for image forming operation. Hereinafter, "axial direction," "radial direction," and "circumferential direction" mean those of the hollow cylindrical body of the drum sleeve 121A, and correspond to the axial direction, radial direction, and circumferential direction of the hollow cylindrical body. The term "axially inner side" means the same side of an object as the middle of the drum sleeve 121A in the axial direction of the drum sleeve 121A, and "axially outer side" means the opposite side of an object from the middle of the drum sleeve 121A.

The flange 121B is press-fitted into a lateral end of the drum sleeve 121A, and rotatably supports the drum sleeve 121A. The flange 121B has a flange main body 60 having a cylindrical shape, and an insertion portion 63 and a supporting portion 61 respectively protruding from both lateral faces of the flange main body 60 in the axial direction (FIG. 5). The flange main body 60 has a helical gear 121D in the outer periphery of the cylindrical shape (see FIG. 4). The helical gear 121D meshes with the above-described charging roller gear 122B, and transmits rotational driving force from the photosensitive drum 121 to the charging roller 122A. At this time, a reaction force associated with the rotational driving force is imparted to the helical gear 121D toward a direction (arrow B in FIG. 4) inclined outwardly in the axial direction of the drum sleeve 121A with respect to a direction perpendicular to the axial direction of the drum sleeve 121A.

The flange main body 60 has a plurality of ribs 601 on the radially inner side thereof. The plurality of ribs 601 extend in the radial direction from a cylindrical central portion 602 located in the central part of the flange main body 60. The ribs 601 are exposed on the axially outer lateral face of the flange main body 60. The ribs 601 form spaces in the inside of the flange 121B. The ribs 601 supplement the rigidity of the flange 121B that is decreased by formation of the spaces in the inside of the flange 121B.

The insertion portion 63 includes a plurality of insertion pieces 631 protruding from the axially inner lateral face of the flange main body 60 toward the axially inner side. The insertion pieces 63 are arranged circularly along the periphery of the inner lateral face of the flange main body 60. The insertion portion 63 is inserted into the drum sleeve 121A with the radially outer surfaces of the insertion pieces 631 sliding on the inner peripheral surface of the drum sleeve 121A. The insertion portion 63 is press-fitted into the drum sleeve 121A. Thus, the drum sleeve 121A and the flange 121B are integrated.

The supporting portion 61 protrudes from the axially outer lateral face of the flange main body 60 to the axially outer side. The supporting portion 61 serves as a rotating shaft for rotation of the drum sleeve 121A. The supporting portion 61 is a cylindrical body having a diameter that is smaller than that of the flange main body 60. The supporting portion 61 is positioned so as to be continuous with the central portion 602 of the flange main body 60. The supporting portion 61 has a plurality of couplings 62 at its axially outer end. The couplings 62 are a plurality of protruding pieces formed along the circumferential direction. The protruding pieces each have an engaging portion 621 and a guiding portion 622. The engaging portion 621 is one edge of the protruding piece extending toward the axially outer side, and the guiding portion 622 is the other edge of the protruding piece inclined from the distal end of the engaging portion 621 toward the base end of the supporting portion 61.

The above-described couplings 62 are provided only in the flange 121B and are not provided in the flange 121C. The structure of the flange 121C is the same as that of the flange 121B in other respects, and so a description will hereinafter be given of the flange 121B.

The housing 301 (FIG. 3) supporting the photosensitive drum 121 has a pair of bearing portions 80 in the front wall 302A and the back wall 302B (upstanding walls). The bearing portions 80 are formed of metal or a resin material having high slidability. The bearing portions 80 have a substantially hollow cylindrical shape, and each have a bearing flange 81, a plurality of positioning pieces 82, and a bearing fixing portion 83. The bearing flange 81 has a fitting surface 811 (third inner peripheral surface) on the inner side thereof.

The bearing fixing portion 83 is connected to the axially inner side of the bearing flange 81. The external diameter of the bearing fixing portion 83 is slightly smaller than the external diameter of the bearing flange 81. The bearing fixing portion 83 has a sliding surface 831 (second inner peripheral surface) on the inner side thereof. The internal diameter of the sliding surface 831 is slightly smaller than the internal diameter of the fitting surface 811 of the bearing flange 81. The positioning pieces 82 are plate-like members extending toward the radially outer side at the boundary between the bearing flange 81 and the bearing fixing portion 83. The positioning pieces 82 are arranged in the circumferential direction at the boundary between the bearing flange 81 and the bearing fixing portion 83.

In FIG. 3, the bearing portions 80 are inserted into openings (not shown) formed in the front wall 302A and the back wall 302B, from the axially outer side. That is to say, in FIG. 5, the outer periphery of the bearing fixing portion 83 is inserted into an opening formed in the back wall 302B. The internal diameter of the opening is slightly larger than the external diameter of the bearing fixing portion 83 and smaller than the maximum external diameter of the positioning pieces 82. Therefore, the positioning pieces 82 come into contact with the axially outer lateral face of the back wall 302B, and the insertion of the bearing portion 80 is thereby stopped. The bearing portions 80 are fixed to the front wall 302A and the back wall 302B with screws (not shown).

Next, a description will be given of problems in the situation where, in the above-described configuration, the supporting portions 61 of the photosensitive drum 121 are directly fitted into the bearing portions 80 fixed to the housing 301 (in the situation where a circular tube member 70 described later is not provided).

Referring to FIG. 5, the flange 121B is press-fitted into the drum sleeve 121A, and the flange 121B is inserted into the bearing portion 80 fixed to the housing 301. At this time, as shown in FIG. 6, the supporting portion 61 of the flange 121B is inserted into a space formed by the sliding surface 831 of the bearing fixing portion 83. As a result, a sliding portion A is formed between the outer peripheral surface 611 and the sliding surface 831.

When the flange 121B is inserted into the bearing portion 80, the couplings 62 located at the distal end of the supporting portion 61 are exposed on the axially outer side of the bearing fixing portion 83 of the bearing portion 80, and faces the fitting surface 811 on the inner side of the bearing flange 81. When the drum unit 300 is attached to the image forming apparatus 100, a drive input gear (not shown) positioned in the apparatus main body engages with the couplings 62 from the axially outer side of the bearing portion 80 (see FIG. 3). More specifically, the drive input gear engages with the engaging portions 621 (FIG. 5) of the couplings 62, and the photosensitive drum 121 is rotationally driven in the direction of arrow D1 in FIG. 3 and FIG. 5.

In the situation where the bearing portions 80 fixed to the housing 301 and the supporting portions 61 of the photosensitive drum 121 directly slide on each other, and the photosensitive drum 121 is rotationally driven, the fitting of the outer peripheral surface 611 and the slid surface 831 determines the rotational stability of the photosensitive drum 121. If the clearance between the outer peripheral surface 611 and the sliding surface 831 is great, the photosensitive drum 121 rotates eccentrically. The eccentricity of the photosensitive drum 121 causes fluctuation of the distance between the developing device 124 and the transfer device 126 located around the photosensitive drum 121, and the photosensitive drum 121. This fluctuation of distance changes the amount of toner moved (the amount of toner developed, the amount of toner transferred), and may cause image defect.

If the clearance (the amount of gap) between the outer peripheral surface 611 and the sliding surface 831 is small, the above eccentricity is less likely to occur. However, when the temperature of the environment where the image forming apparatus 100 is used rises, thermal expansion occurs in the flange 121B made of a resin material. Therefore, the outer peripheral surface 611 of the supporting portion 61 also expands in the radial direction, and the clearance between the outer peripheral surface 611 of the supporting portion 61 and the sliding surface 831 of the bearing portion 80 is lost. As a result, the outer peripheral surface 611 of the supporting portion 61 is fixed to the fitting surface 811 of the bearing portion 80, and rotation failure of the photosensitive drum 121 results.

In addition, when the photosensitive drum 121 is rotationally driven, the outer peripheral surface 611 of the supporting portion 61 wears due to friction in the sliding portion A. As a result, the external diameter of the supporting portion 61 changes, and the same problem as that in the above-described eccentricity of the photosensitive drum 121 occurs. As described above, in the situation where the flange 121B (supporting portion 61) of the photosensitive drum 121 is directly rotatably supported by the bearing portion 80, various problems occur due to friction in the sliding portion caused by rotation and thermal expansion caused by the change in environmental temperature. Therefore, changes in the duration of use of the apparatus and the environmental temperature makes the stable rotational driving of the photosensitive drum 121 difficult.

In this embodiment, as shown in FIG. 7 to FIG. 9, a circular tube member 70 is located between the flange main body 60 and the bearing portion 80. This configuration solves the above-described problems. The circular tube member 70 is made of metal, preferably a stainless material. The circular tube member 70 has a press-fit portion 701 and a flange portion 702.

The press-fit portion 701 has a thin-walled tubular shape. The press-fit portion 701 has, on the inner side thereof, a press-fit surface 712 (first inner peripheral surface) that forms a space into which the supporting portion 61 of the flange 121B is inserted. The press-fit portion 701 has a sliding surface 711 (first outer peripheral surface) that is opposite from the press-fit surface 712 and that is inserted into the bearing fixing portion 83 of the bearing portion 80 and comes into contact with the sliding surface 831. The flange portion 702 has a flange shape that protrudes from the axially inner end of the sliding surface 711 toward the radially outer side. The circular tube member 70 is attached to the supporting portion 61 of the flange 121B of the photosensitive drum 121. That is to say, by press-fitting the supporting portion 61 into the space formed by the press-fit surface 712, the circular tube member 70 is integrally fixed to the photosensitive drum 121.

In this embodiment, as shown in FIG. 9, the diameter of the press-fit surface 712 of the press-fit portion 701 decreases toward the axially outer side (the direction in which the supporting portion 61 is press-fitted into the press-fit portion 701). The smallest diameter portion on the axially outer side of the press-fit surface 712 is smaller than the external diameter of the distal end (the axially outer end) of the supporting portion 61 of the flange 121B. Therefore, when the supporting portion 61 is press-fitted into the space formed by the press-fit surface 712 of the circular tube member 70, the distal end of the supporting portion 61 expands the axially outer part of the press-fit portion 701 slightly radially outward.

Therefore, while the flange 121B is being press-fitted into the circular tube member 70, a radial force that is uniform throughout the circumferential direction acts on the press-fit surface 712 and the outer peripheral surface 611 of the supporting portion 61. As a result, press-fitting is completed with the axis of the circular tube member 70 aligned with the axis of the supporting portion 61 of the flange 121B. With the photosensitive drum 121 and the circular tube member 70 integrally fixed, the circular tube member 70 is inserted into the space inside the bearing fixing portion 83 of the bearing portion 80.

In this embodiment, as shown in FIG. 9, the sliding surface 711 of the press-fit portion 701 decreases in diameter toward the axially outer side (the direction in which the press-fit portion 701 is inserted into the space formed by the sliding surface 831). As described above, when the supporting portion 61 is inserted into the circular tube member 70, the axially outer end of the press-fit portion 701 is slightly expanded radially outward. As a result, the shape of the sliding surface 711, that decreases in diameter toward the axially outer side, changes into a shape substantially parallel to the axial direction in sectional view shown in FIG. 8. Therefore, when the circular tube member 70 is inserted into the bearing portion 80, the sliding surface 711 and the sliding surface 831 can be in contact with each other over a wide area in the axial direction.

In this way, as shown in FIG. 8, the circular tube member 70 is located between the photosensitive drum 121 and the bearing portion 80. The positional relationship between components in the sectional view of FIG. 8 will be described. The insertion portion 63 of the flange 121B is press-fitted into the axially outer end of the drum sleeve 121A. The flange main body 60 is located so as to be adjacent to the outer peripheral surface of the drum sleeve 121A. In the outer periphery of the flange main body 60, the helical gear 121D is formed. Inside the flange main body 60, the plurality of ribs 601 are disposed in the circumferential direction.

The supporting portion 61 that protrudes from the axially outer lateral face of the flange main body 60 is press-fitted into the press-fit portion 701 of the circular tube member 70. By inserting the press-fit portion 701 into the bearing fixing portion 83 of the bearing portion 80, the photosensitive drum 121 is rotatably supported relative to the bearing portion 80. The couplings 62 located at the axially outer end of the supporting portion 61 penetrate the internal space formed by the sliding surface 831 of the bearing fixing portion 83 to a position where they face the fitting surface 811, the inner peripheral surface of the bearing flange 81. Thus, the couplings 62 are exposed in the axially outer part of the bearing portion 80.

For the fitting of the sliding surface 711 and the sliding surface 831, in order to maintain high rotation accuracy of the photosensitive drum 121, for example, the sliding surface 711 is set within a fitting tolerance range of not less than +0.01 mm and not more than +0.05 mm, and the sliding surface 831 is set within a fitting tolerance range of not less than −0.05 mm and not more than −0.01 mm. The clearance between the sliding surface 711 and the sliding surface 831 set by the above fitting tolerances is less likely to change when the environment where the printer 100 is used changes and the environmental temperature rises.

That is to say, when the environmental temperature rises, the circular tube member 70 made of a stainless material is less likely to thermally expand. The circular tube member 70 suppresses the thermal expansion of the supporting portion 61 of the flange 121B on the radially inner side of the circular tube member 70. As a result, the clearance between the sliding surface 711 of the circular tube member 70 and the sliding surface 831 of the bearing portion 80 is less likely to change. Therefore, an extra load is less likely to be put on the rotation of the photosensitive drum 121, and the rotation of the photosensitive drum 121 is stably maintained.

In this embodiment, the flange portion 702 provided in the circular tube member 70 protects the flange main body 60 and restricts the axial position of the photosensitive drum 121. As described above, when a rotational driving force is transmitted from the apparatus main body to the couplings 62 exposed on the axially outer side of the bearing portion 80, the photosensitive drum 121 rotates (see FIG. 3). The helical gear 121D (FIG. 4) provided in the flange main body 60 of the flange 121B meshes with the charging roller gear 122B, and rotational driving force is transmitted from the photosensitive drum 121 to the charging roller 122A.

At this time, as shown in FIG. 4, because of the structure of the helical gear 121D, a reaction force is applied to the helical gear 121D in a direction (arrow B) outwardly inclined in the axial direction with respect to the straight line C perpendicular to the rotation axis. Assume that, in FIG. 4, the base end of arrow B is the meshing point between the helical gear 121D and the charging roller gear 122B in the circumferential direction. Under the above reaction force, a force moving to the axially outer side as shown by arrow A in FIG. 4 acts on the photosensitive drum 121.

As shown in FIG. 6, in the situation where the circular tube member 70 is not provided, the end faces 602 of the ribs 601 of the flange main body 60 face the end portion 832 of the bearing fixing portion 83 of the bearing portion 80 in the axial direction. Therefore, when the above moving force acts on the photosensitive drum 121, the photosensitive drum 121 moves in the direction of arrow A in FIG. 4, and then the end faces 602 of the plurality of ribs 601 come into contact with the end portion 832 of the bearing fixing portion 83 while being rotated. As a result, the end faces 602 of the ribs 601 are abraded or broken due to friction.

However, in this embodiment, as shown in FIG. 6, the flange portion 702 of the circular tube member 70 is located between the lateral faces of the ribs 601 and the end portion 832 of the bearing fixing portion 83 in the axial direction. Therefore, when the photosensitive drum 121 moves to the axially outer side (in the direction of arrow A in FIG. 4), the flange portion 702 made of a metal material comes into contact with the end portion 832 of the bearing fixing portion 83 first, and therefore the breakage of the ribs 601 may be suppressed. The contact of the flange portion 702 with the end portion 832 of the bearing fixing portion 83 stops the movement of the photosensitive drum 121 to the axially outer side. Therefore, the position on the axially outer side of the photosensitive drum 121 may be restricted by the flange portion 702.

In this embodiment, as shown in FIG. 8, when the supporting portion 61 is inserted into the bearing fixing portion 83 of the bearing portions 80, the couplings 62 are inserted to a part where they face the fitting surface 811 on the inner side of the bearing flange 81. As a result, the couplings 62 are exposed in the axially outer part of the bearing portions 80. Therefore, a rotational driving force can be transmitted to the photosensitive drum by utilizing the space on the axially outer side of the sliding surface between the circular tube member 70 and the bearing portion 80. In addition, since the fitting surface 811 has an internal diameter greater than that of the sliding surface 831, the degree of freedom of the shape of the drive input gear (not shown) engaged from the apparatus main body side is improved. A drive input gear having a diameter greater than the external diameter of the couplings 62 can be connected to the couplings 62 from the apparatus main body side.

Although a drum unit 300 and a image forming apparatus 100 having the drum unit 300 according to an embodiment of the present disclosure have been described, the present disclosure is not limited to this, and for example, the following modifications are possible.

(1) Although, in the above-described embodiment, the sliding surface 711 and the press-fit surface 712 of the press-fit portion 701 of the circular tube member 70 decreases in diameter toward the axially outer side, the present disclosure is not limited to this. Both the sliding surface 711 and the press-fit surface 712 of the press-fit portion 701 may extend parallel to the axial direction, or one of the sliding surface 711 and the press-fit surface 712 may decrease in diameter toward the axially outer side. (2) Although, in the above-described embodiment, the helical gear 121D provided in the outer periphery of the flange main body 60 transmits a rotational driving force to the charging roller gear 122B, the present disclosure is not limited to this. For example, a rotational driving force may be inputted into the helical gear 121D from the apparatus main body, and the photosensitive drum 121 may be rotated by the rotational driving force. Also in this situation, a rotational driving force is imparted to the helical gear 121D, as shown in FIG. 4, in a direction (arrow B) outwardly inclined in the axial direction with respect to a straight line C perpendicular to the rotation axis.

Therefore, when the photosensitive drum 121 moves to the axially outer side (the direction of arrow A), the flange portion 702 provided in the circular tube member 70 comes into contact with the end portion 832 of the bearing fixing portion 83 first, and therefore breakage of the ribs 601 is suppressed. The contact of the flange portion 702 with the end portion 832 of the bearing fixing portion 83 stops the movement of the photosensitive drum 121 to the axially outer side. Therefore, the position on the axially outer side of the photosensitive drum 121 is restricted by the flange portion 702.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A drum unit comprising:

a photosensitive drum including a hollow cylindrical drum sleeve having a surface on which a latent image is formed and bearing a toner image corresponding to the latent image, a flange press-fitted into an end portion of the drum sleeve and rotatably supporting the drum sleeve, and a supporting portion made of resin, protruding from a lateral face of the flange in an axial direction of the drum sleeve, and serving as a rotating shaft for rotation of the drum sleeve;

a circular tube member made of metal, extending in the axial direction, and having a first inner peripheral surface forming a space, and a first outer peripheral surface that is opposite from the first inner peripheral surface;

a housing rotatably supporting the photosensitive drum; and a bearing portion fixed to the housing, having a second inner peripheral surface facing the first outer peripheral surface and forming a space, wherein the supporting portion is press-fitted into the first inner peripheral surface of the circular tube member, and the circular tube member is inserted into the second inner peripheral surface of the bearing portion, and wherein the flange has a helical gear to which a rotational driving force or reaction force associated with a rotational driving force moving the photosensitive drum toward the outer side in the axial direction is imparted, and wherein the circular tube member has a flange portion protruding from the first outer peripheral surface toward the outer side in a radial direction of the drum sleeve and located between the bearing portion and the lateral face of the flange in the axial direction.

2. The drum unit according to claim 1, wherein the first inner peripheral surface of the circular tube member decreases in diameter in a direction in which the supporting portion is press-fitted.

3. The drum unit according to claim 1, wherein the first outer peripheral surface of the circular tube member decreases in diameter in a direction in which the circular tube member is inserted into the bearing portion.

4. The drum unit according to claim 1, wherein the flange has therein a plurality of ribs extending in the axial direction and exposed on a lateral face, and the flange portion is located so as to face ends of the plurality of ribs exposed on the lateral face.

5. The drum unit according to claim 1, comprising a charging device substantially uniformly charging the peripheral surface of the photosensitive drum.

6. The drum unit according to claim 1, wherein the housing has an upstanding wall facing the flange in the axial direction, the bearing portion has a hollow cylindrical shape having a second outer peripheral surface attached to the upstanding wall and having therein the second inner peripheral surface, the supporting portion penetrates the circular tube member, and has a coupling through which a rotational driving force is transmitted to the photosensitive drum, at the distal end in the axial direction of the penetrating supporting portion, and by inserting the circular tube member into the bearing member, the coupling protrudes on the outer side in the axial direction of the second inner peripheral surface of the bearing portion.

7. The drum unit according to claim 6, wherein the bearing portion has a third inner peripheral surface connected to the outer side in the axial direction of the second inner peripheral surface and facing the coupling in the radial direction, and the third inner peripheral surface has an internal diameter greater than that of the second inner peripheral surface.

8. An image forming apparatus comprising:

a drum unit including:

a photosensitive drum including a hollow cylindrical drum sleeve having a surface on which a latent image is formed and bearing a toner image corresponding to the latent image, a flange press-fitted into an end of the drum sleeve and rotatably supporting the drum sleeve, and a supporting portion made of resin, protruding from a lateral face of the flange in an axial direction of the drum sleeve, and serving as a rotating shaft for rotation of the drum sleeve, a charging device substantially uniformly charging a peripheral surface of the photosensitive drum, a circular tube member made of metal, extending in the axial direction, and having a first inner peripheral surface forming a space, and a first outer peripheral surface that is opposite from the first inner peripheral surface, a housing rotatably supporting the photosensitive drum, and a bearing portion fixed to the housing, having a second inner peripheral surface facing the first outer peripheral surface and forming a space;

an exposure device that irradiates the peripheral surface of the photosensitive drum charged by the charging device with light and forms the latent image;

a developing device that supplies toner to the peripheral surface of the photosensitive drum on which the electrostatic latent image is formed;

a transfer device that transfers the toner image formed on the peripheral surface of the photosensitive drum; and a cleaning device that removes toner remaining on the peripheral surface of the photosensitive drum after the transfer, wherein the supporting portion is press-fitted into the first inner peripheral surface of the circular tube member, and the circular tube member is inserted into the second inner peripheral surface of the bearing portion, and wherein the flange has a helical gear to which a rotational driving force or reaction force associated with a rotational driving force moving the photosensitive drum toward the outer side in the axial direction is imparted, and wherein the circular tube member has a flange portion protruding from the first outer peripheral surface toward the outer side in a radial direction of the drum sleeve and located between the bearing portion and the lateral face of the flange in the axial direction.

9. The image forming apparatus according to claim 8, wherein the first inner peripheral surface of the circular tube member decreases in diameter in a direction in which the supporting portion is press-fitted.

10. The image forming apparatus according to claim 8, wherein the first outer peripheral surface of the circular tube member decreases in diameter in a direction in which the circular tube member is inserted into the bearing portion.

11. The image forming apparatus according to claim 8, wherein the flange has therein a plurality of ribs extending in the axial direction and exposed on a lateral face, and the flange portion is located so as to face ends of the plurality of ribs exposed on the lateral face.

12. The image forming apparatus according to claim 8, wherein the housing has an upstanding wall facing the flange in the axial direction, the bearing portion has a hollow cylindrical shape having a second outer peripheral surface attached to the upstanding wall and having therein the second inner peripheral surface, the supporting portion penetrates the circular tube member, and has a coupling through which a rotational driving force is transmitted to the photosensitive drum, at the distal end in the axial direction of the penetrating supporting portion, and by inserting the circular tube member into the bearing member, the coupling protrudes on the outer side in the axial direction of the second inner peripheral surface of the bearing portion.

13. The image forming apparatus according to claim 12, wherein the bearing portion has a third inner peripheral surface connected to the outer side in the axial direction of the second inner peripheral surface and facing the coupling in the radial direction, and the third inner peripheral surface has an internal diameter greater than that of the second inner peripheral surface.

* * * * *